United States Patent [19]

Methner et al.

[11] 4,117,286

[45] Sep. 26, 1978

[54] ELECTRIC SWITCH

[75] Inventors: Arnold Methner, Tuttlingen; Reinhold Mesle, Aldingen, both of Germany

[73] Assignee: J. & J. Marquardt, Germany

[21] Appl. No.: 693,154

[22] Filed: Jun. 7, 1976

[30] Foreign Application Priority Data

Jun. 13, 1975 [DE] Fed. Rep. of Germany ..... 2526485

[51] Int. Cl.[2] ..... H01H 15/18

[52] U.S. Cl. ..... 200/76; 200/73; 200/153 LB; 200/237; 200/250

[58] Field of Search ..... 200/237-241, 200/249-253, 153 LB, 76, 73, 77, 271, 275; 338/198, 200, 215

[56] References Cited

U.S. PATENT DOCUMENTS

| | | | |
|---|---|---|---|
| 2,958,838 | 11/1960 | Puerner et al. | 338/215 X |
| 3,218,428 | 11/1965 | Gauthier | 200/251 |
| 3,622,934 | 11/1971 | Yano | 338/198 |
| 3,858,017 | 12/1974 | Bertozzi | 200/153 LB |

FOREIGN PATENT DOCUMENTS

| | | | |
|---|---|---|---|
| 2,412,812 | 2/1976 | Fed. Rep. of Germany | 200/239 |
| 313,234 | 8/1971 | U.S.S.R. | 200/238 |

*Primary Examiner*—Harold Tudor
*Attorney, Agent, or Firm*—McGlew and Tuttle

[57] ABSTRACT

The electric switch has an angular movable contact element formed by a pair of angled legs interconnected at a bend, with the outer surface of the bend bearing on a support. A movable contact at the end of one leg of the contact element is engageable with a fixed contact. A spring-loaded swivel member bears against that side of the leg, carrying the movable contact, opposite to the side facing the fixed contact, at a point spaced from the bend, and is operable by a slidable switch actuator movable in a contact element displacement direction. A loading spring has one end engaged in the swivel member and its opposite end engaged in the actuator. The swivel member carries a movable contact or is formed with a contact surface which, responsive to movement of the actuator in a switch closing direction, is engageable with an additional fixed contact of the switch. A camming device is cooperable with the swivel member to effect a direct engagement, as distinguished from a sliding engagement, of the swivel member contact or contact surface with the associated fixed contact.

11 Claims, 2 Drawing Figures

ELECTRIC SWITCH

FIELD AND BACKGROUND OF THE INVENTION

This invention relates to an electric switch with at least one substantially angular contact element having a pair of angled legs interconnected at a bend, with the outer surface of the bend bearing on a support, with at least one fixed contact being associated with the movable contact element and a spring-loaded swivel member being mounted on the switch actuator and bearing on that side of one angled leg of the contact element remote from the fixed contact and at a spacing from the bend, the end of the loading spring, remote from the swivel member, bearing on the actuator.

Electric switches of this type are already known, and they are installed, more particularly, in electric hand tools.

SUMMARY OF THE INVENTION

The objective of the present invention is to develop a switch of this type so that it can perform another switching operation in addition to its known present switching function.

To solve this problem, in accordance with the invention, the swivel member has a contact or contact surface which cooperates with at least one additional fixed contact of the switch. The swivel member thus forms a second contact member, in accordance with the invention, and which second contact member assumes its switching position or release position in dependence on the respective position of the actuator. In the switch embodying the invention, the translatory movement of the swivel member is thus utilized for an additional switching operation. In the direction of displacement of the actuator, the swivel member is entrained by the actuator on which it is pivotally mounted. It is thus possible to open or close an additional circuit or circuits by means of the swivel member.

In a preferred embodiment of the invention, the swivel member is displaceable transversely to the displacement direction of the actuator, against the force of the loading spring, so that it can be pressed against its associated fixed contact with the necessary contact pressure. Another feature of the invention is that the actuator, designed as a reciprocable actuator, is also an actuator of a potentiometer, particularly of an electronic control.

In accordance with another feature of the invention, the contact element bears on a contact plate which is electrically connected to a connection element of the switch, or made integral with the connection element, such as a switch prong. The current flows from the connection element through the contact plate and the movable contact element to the fixed contact.

In a further development of the invention, one angled leg of the movable contact element is designed, at least at its points coming in contact with the swivel member, as an abutment for the swivel member or as a sliding cam, or else carries a cam, and the part of the swivel member bearing thereagainst is plate-shaped. The plate-shaped part of the swivel member is moved past this cam or cam surface during operation of the switch, while a relative rotation or swiveling movement of the swivel member takes place at the same time.

In accordance with another embodiment of the invention, a second sliding cam, or cam surface, is arranged on an angled leg of the movable contact element in front of the first mentioned abutment or sliding cam as viewed in the displacement direction of the swivel member, and the plate-shaped part of the swivel member bears, in the switching position, at least on the second cam or cam surface. This one angled leg of the contact element is held down, in the switching position, by engagement of the swivel member with the first-mentioned sliding cam or with both sliding cams, and thus the movable contact, carried by the movable contact element, is pressed firmly by the loading spring of the swivel member against the fixed contact or contacts to be bridged. The loading spring preferably is designed as a coil compression spring.

A particular advantage of the present invention arises from the fact that the extent of displacement of the actuator, when moving the swivel member to make contact with its associated fixed contact, is greater than that of the contact element. Thus, when the switch is actuated, the first contact pair, including the movable contact element, is initially closed and, after a further movement of the actuator, the second contact pair, including the swivel member and its associated fixed contact, is closed. The swivel member preferably is electrically conductive, so that current can flow, in its closed position, through the associated contact pair and the swivel member to the movable contact element and from there to the corresponding terminal of the switch, and vice versa.

The special field of application of the invention switch, as mentioned above, is in electrical hand tools, particularly those with electronic switching and a built-in potentiometer. In these tools, variation of the tool speed is effected by displacement of the actuating pusher. A small displacement corresponds to a low speed while the maximum speed is attained with complete displacement of the actuator pusher. It is desirable that the electronic system of the speed control is shut off at maximum speed, to prevent thermal overload, particularly of the controllable rectifier.

The switch embodying the invention is highly suitable for this purpose, because it has two contact pairs that can be closed successively and a potentiometer that can be controlled by the actuator. The switch formed by the fixed contact and the movable contact of the swivel member forms the above-mentioned device for cutting off the electronic system. The mechanism is so designed that the circuit for the driving motor is initially closed by means of the movable contact element, and subsequently, the speed is increased by means of the potentiometer and the electronic system, and that finally, when the maximum speed has been attained, the electronic system is bridged or disconnected by the swivel member and its additional fixed contact. Naturally, the switch can be designed as a single pole switch or as a multiple pole switch. Furthermore, it is possible to arrange the entire electronic system for the speed control, in addition to the potentiometer, in the switch housing.

An object of the invention is to provide an improved electric switch of the type having an angular movable contact element, a spring-loaded swivel member mounted on a switch actuator bearing on the movable contact element, and a loading spring engaged between the swivel member and the switch actuator.

Another object of the invention is to provide such an improved electric switch which can perform a switching operation additional to the known switching function thereof.

A further object of the invention is to provide such an improved electric switch which is particularly suitable for speed-controlled electrical hand tools.

For an understanding of the principles of the invention, reference is made to the following description of a typical embodiment thereof as illustrated in the accompanying drawings.

DESCRIPTION OF THE PREFERRED EMBODIMENT

Figure 1:
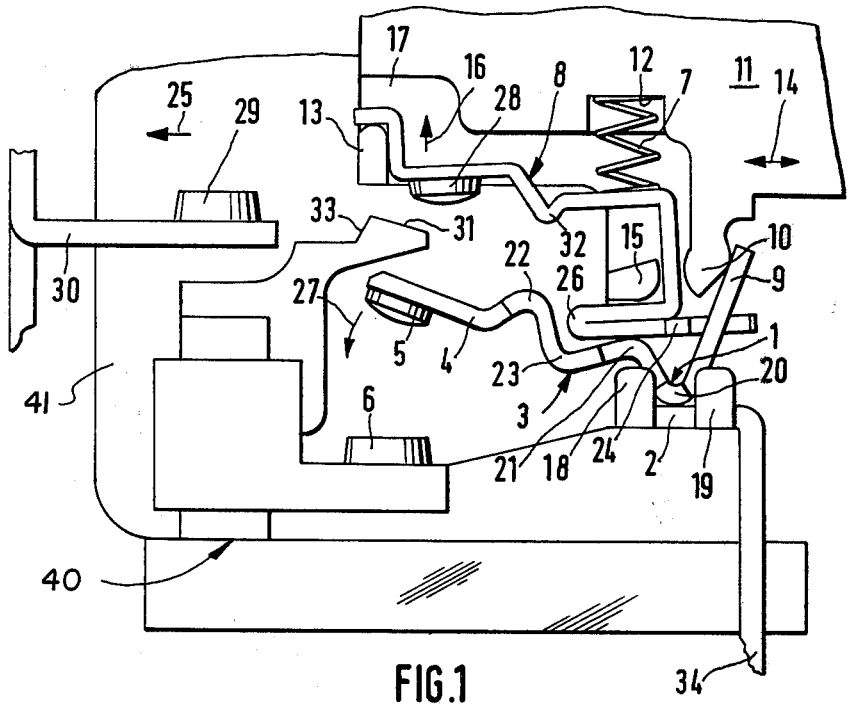
FIG. 1 is an elevation view, with parts removed, showing a switch, embodying the invention, in the starting or open position.

Referring to the drawings, an electric switch embodying the invention includes a substantially angular movable contact element 3 having a pair of angled legs 4 and 9 interconnected at a bend 1, with the outer surface of bend 1 bearing on an electrically conductive contact plate 2 mounted in housing or base 40 of the switch. On the underside of one leg, preferably the longer angled leg 4, there is arranged a movable contact 5 which is cooperable with a fixed contact 6 mounted in housing or base 40, the contact 5 being spaced from the contact 6 in the starting or open position of the switch, as shown in FIG. 1. One angled leg 4 of movable contact element 3 is loaded, indirectly, through a swivel member 8 by a loading spring 7 designed as a spiral or coil compression spring. The other angled leg 9 accordingly is pressed against a shoulder 10 of a switch actuator 11 which is displaceable in the direction of the double arrow 14.

The upper end of loading spring 7 is seated in a recess 12 of actuator 11, and swivel member 8 is pivotally mounted on the rounded end of a ledge 13 extending, perpendicularly to the plane of the drawings, from a switch wall or a detachable cover 41 of housing or base 40. Swivel member 8 is secured against displacement, in the direction of movement of actuator 11 which is designed as a pusher, by the above-mentioned shoulder 10 of the pusher, on the one hand, and by an additional shoulder 15 of the pusher, on the other hand. Swivel member 8 can move in the direction of arrow 16, disengaging swivel ledge 13 because the recess 17 in actuator 11 is sufficiently deep at the bearing point.

Figure 2:
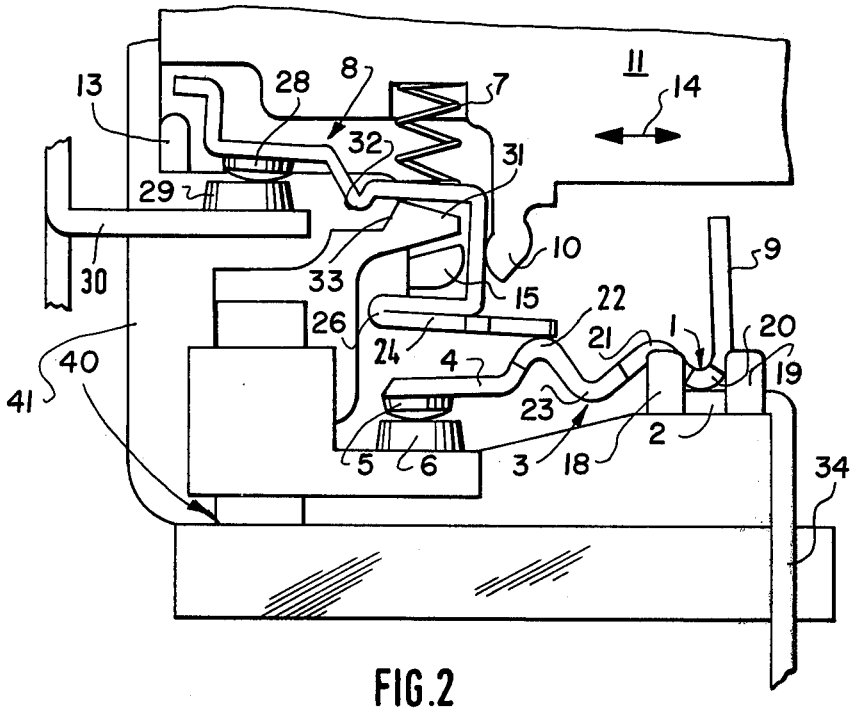
FIG. 2 is a view similar to FIG. 1 showing the switch in its operated or closed position.

Contact element 3 is secured against displacement in the direction of double arrow 14 by two pairs of tongues 18 and 19 on opposite sides of contact plate 2, contact element 3 having oppositely extending shoulders 20 extending, perpendicularly to the picture plane, between tongues 18 and 19. Starting at bend 1, one angled leg 4 of contact element 3 is undulated to form two cams 21 and 22 extending in the direction of swivel member 8, as well as a cam 23 extending in the opposite direction. A plate-shaped part 24 of swivel member 8 engages the outer surface of cam 21 and, at this point, the force of loading spring 7 is transmitted to movable contact element 3 in the starting or open position of the switch. When actuator 11 is pressed in the direction of the arrow 25, the front end 26 of plate-shaped part 24 strikes the facing flank of cam 22 to effect a pivotal movement of contact element 3 in the direction of arrow 27. As can be seen from FIG. 2, plate-shaped part 24 bears, in the switching or closed position of the switch, and particularly with its rear end, on the outer surface of cam 22 and assures, by means of loaded spring 7, that movable contact 5 is pressed firmly against fixed contact 6.

On its surface facing contact element 3, swivel member 8 carries a movable contact 28 cooperable with an opposing contact 29 which, in the illustrated embodiment of the invention, is a fixed contact. Contact 29 is electrically connected with an electrically conductive element 30, such as a terminal of the switch. In order to avoid dragging or sliding contact-making between contacts 28 and 29, a snap mechanism is provided and consists substantially of a stop cam 31 and a cooperating member on swivel member 8, preferably provided by molding, the snap mechanism also including the loading spring 7.

As actuator 11, and thus loading spring 7 and swivel member 8, are moved in the direction of arrow 25, the cam-type stop member 32 strikes stop cam 31 which is in its range of motion, and this leads to a pivoting movement in the direction of motion of the front end of swivel member 8 and thus to the lifting of movable contact 28 in the direction of arrow 16. When stop member 32 has reached the highest elevation of stop cam 31, movable contact 28 is exactly above its cooperating contact 29. Due to the steep flank 33 of cam 31, movable contact 28 strikes its cooperating contact 29 abruptly. The contacts are also separated in a similar manner.

Actuator 11 can also be pressed inwardly against the force of a restoring spring, so that the contact pairs are automatically disengaged or opened after cessation of the actuating force. In addition, "follow-up" can be provided to permit actuator 11 to move, through a certain extent, in the direction of arrow 25, even if contact pair 28, 29 is closed.

From the foregoing description, it will be clear that the contact pair 5, 6 is initially closed. Subsequently, the plate-shaped part 24 slides along cam 22 until the contact pair 28, 29 is also closed. When current is supplied through connecting element or switch terminal 34, it flows initially through movable contact element 3 and contact 5 to fixed contact 6, from which it is conducted to the controlled elements in a suitable manner. When contact 28 subsequently engages contact 29, the current is conducted from movable contact element 3 through swivel member 8, contact 28, and to the opposite contact 29, so that it will then flow through the conductor 30. As stated, the movement of actuator 11 can also be utilized for actuating a potentiometer of an electrical hand tool, which potentiometer has not been shown.

While a specific embodiment of the invention has been shown and described in detail to illustrate the application of the principles of the invention, it will be understood that the invention may be embodied otherwise without departing from such principles.

What is claimed is:

1. A push button actuated electric switch comprising, in combination, at least one substantially angular movable contact element having a pair of angled legs interconnected at a bend; a support; the outer surface of said bend bearing on said support; at least one fixed contact engageable by one leg of each movable contact element; a push button switch actuator movable rectilinearly of each movable contact element in a contact element displacement direction; a swivel member swingably mounted on said push button actuator and bearing against that side of said one angled leg opposite to the side facing the associated fixed contact and at a distance from said bend; loading spring means engaged between said swivel member and said push button actuator and biasing said swivel member against each movable contact element; said swivel member being movable, relative to said push button actuator, transverse to such contact element displacement direction of said push button actuator and against the bias of said loading spring means; said swivel member being movable, as a unit with said push button actuator, rectilinearly of said one leg of each contact element, upon rectilinear movement of said push button actuator in a contact closing direction, to slide along said one leg and pivot each movable contact element to engage the associated fixed contact; additional electric contact means operable by such swingable and transverse movement, of said swivel member relative to said push button actuator, responsive to further displacement of said push button actuator in such contact closing direction subsequent to engagement of each movable contact element with the associated fixed contact; and means on said push button actuator operable, when said push button actuator is displaced in the contact opening direction, to engage the other leg of each movable contact element to pivot the movable contact element to disengage its one leg from the associated fixed contact.

2. An electric switch, as claimed in claim 15, in which said additional contact means includes a fixed contact.

3. An electric switch, as claimed in claim 2, in which said additional electric contact means includes a movable contact carried by said swivel member and engageable with said last-mentioned fixed contact.

4. An electric switch, as claimed in claim 1, in which said additional electric contact means includes a movable contact carried by said swivel member, and a fixed contact engageable by said movable contact; a stationary stop cam in the path of movement of said swivel member during such further displacement of said push button actuator; and an abutment on said swivel member engageable with such stationary stop cam to lift said swivel member relative to said push button actuator when said movable contact carried by said swivel member is substantially aligned with the associated switch contact for snap action engagement of said movable contact with the associated fixed contact under the action of said loading spring means.

5. An electric switch, as claimed in claim 1, including a stationary stop cam forming, conjointly with said loading spring means and said swivel member, a snap mechanism for said movable contact of said swivel member.

6. An electric switch, as claimed in claim 1, in which said bend bears on an electrically conductive contact plate; and a connection element for the switch electrically connected to said contact plate.

7. An electric switch, as claimed in claim 6, in which said contact plate is integral with said connection element.

8. An electric switch, as claimed in claim 1, in which said one angled leg of said movable contact element is formed with an abutment engageable with said swivel member; said swivel member having a plate-shaped part bearing on said abutment.

9. An electric switch, as claimed in claim 8, in which said abutment constitutes a sliding cam for said plate-shaped part of said swivel member.

10. An electric switch, as claimed in claim 8, in which said one angled leg carries a cam constituting said abutment and engageable with said plate-shaped bearing part of said swivel member.

11. An electric switch, as claimed in claim 9, in which said one angled leg is formed with a second sliding cam displaced from said first-mentioned sliding cam in the displacement direction of said actuator and said swivel member in closing said switch; said plate-shaped part of said swivel member, in the closed position of said switch, bearing on said second sliding cam.

* * * * *